US005435565A

United States Patent [19]

Benaderet

[11] Patent Number: 5,435,565

[45] Date of Patent: Jul. 25, 1995

[54] BOARD GAME RELATING TO STRESS

[76] Inventor: David M. Benaderet, 1421 Kingsbury Dr., Casper, Wyo. 82609

[21] Appl. No.: 276,669

[22] Filed: Jul. 18, 1994

[51] Int. Cl.[6] ..... A63F 3/00

[52] U.S. Cl. ..... 273/243

[58] Field of Search ..... 273/242, 243, 248, 249

[56] References Cited

U.S. PATENT DOCUMENTS

| | | | |
|---|---|---|---|
| 4,065,131 | 12/1977 | Martin | 273/243 |
| 4,279,422 | 7/1981 | Shaw | 273/243 X |
| 4,718,675 | 1/1988 | Rosenberg | 273/243 |
| 5,071,134 | 12/1991 | Burroughs | 273/249 |
| 5,104,127 | 4/1992 | Whitney | 273/243 |
| 5,143,378 | 9/1992 | Joel | 273/243 |
| 5,308,079 | 5/1994 | Dreznick et al. | 273/249 |

FOREIGN PATENT DOCUMENTS

| | | | |
|---|---|---|---|
| 2219217 | 12/1989 | United Kingdom | 273/249 |

*Primary Examiner*—William E. Stoll

[57] ABSTRACT

A board game relating to stress comprising a plurality of game pieces each representing a player; at least one die; a plurality of stacks of situation cards with the stacks representing categories of stressful situations, cheerful situations, and combinations thereof and with each situation card describing an action required of a player; a plurality of certificates with each certificate representing a number of years of a player's life with certificates being accumulated and forfeited based on situations encountered; a stack of anti-stress cards with each card representing a way of avoiding a loss of certificates when encountering stressful situations requiring the forfeiture thereof; and a game board having a starting space thereon representing the initiation of a journey through life, an ending space thereon representing the completion of the journey, and a plurality of situation spaces therebetween representing stressful categories, cheerful categories, and combinations thereof with each category represented on the board keyed to a corresponding stack of situation cards of the same category.

6 Claims, 4 Drawing Sheets

MIGRAINE HEADACHE
70
80
ULCER
71
81
NERVOUS BREAKDOWN
72
82
IT CAN GO EITHER WAY
73
83
SATURDAY SUNDAY
74
84
MAJOR HOLIDAY
75
85

BOARD GAME RELATING TO STRESS

BACKGROUND OF THE INVENTION

1. Field of the Invention

The present invention relates to a board game relating to stress and more particularly pertains to whimsically allowing players to simulate stressful situations and cheerful situations in life with a board game relating to stress.

2. Description of the Prior Art

The use of board games is known in the prior art. More specifically, board games heretofore devised and utilized for the purpose of simulating stressful situations and cheerful situations are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,042,245 to Zarour discloses a game board with coded dice and game pieces. U.S. Pat. No. 4,991,853 to Lott discloses a financial board game apparatus. U.S. Pat. No. 5,007,650 to Reed et al. discloses a method of playing a board game of college social life. U.S. Pat. No. 5,009,429 to Auxier discloses an investment game and method of advertisement. U.S. Pat. No. 5,054,775 to Banks et al. discloses a game relating to Personal Relationships. U.S. Pat. No. 5,104,127 to Whitney discloses a board game.

While these devices fulfill their respective, particular objectives and requirements, the aforementioned patents do not describe a board game relating to stress that whimsically allows players to simulate stressful situations and cheerful situations in life.

In this respect, the board game relating to stress according to the present invention substantially departs from the conventional concepts and designs of the prior art, and in doing so provides an apparatus primarily developed for the purpose of whimsically allowing players to simulate stressful situations and cheerful situations in life.

Therefore, it can be appreciated that there exists a continuing need for new and improved board game relating to stress which can be used for whimsically allowing players to simulate stressful situations and cheerful situations in life. In this regard, the present invention substantially fulfills this need.

SUMMARY OF THE INVENTION

In the view of the foregoing disadvantages inherent in the known types of board games now present in the prior art, the present invention provides an improved board game relating to stress. As such, the general purpose of the present invention, which will be described subsequently in greater detail, is to provide a new and improved board game relating to stress and method which has all the advantages of the prior art and none of the disadvantages.

To attain this, the present invention essentially comprises, in combination, six game pieces each formed in a shape of a numbered medicine bottle and each representing a player. A first dice and a second dice are included with each dice having a box-shape with six faces. The first dice further has its faces numbered with dotted indica from one to six. The second dice further has two opposing faces with a pair of snake eyes inscribed thereon, two opposing faces with the word "even" inscribed thereon, and two opposing faces with the word "odd" inscribed thereon. Six stacks of situation cards are included and represent six categories of stressful situations, cheerful situations, and combinations thereof and with each card describing situations and corresponding actions required of a player. Each card of the first stack describes "Migraine Headache" stressful situations. Each card of the second stack describes "Ulcer" stressful situations. Each card of the third stack describes "Nervous Breakdown" stressful situations. Each card of the fourth stack describes "It Can Go Either Way" stressful situations and cheerful situations. Each card of the fifth stack describing "Saturday, Sunday" cheerful situations. Lastly, each card of the sixth stack describes "Major Holiday" cheerful situations.

A plurality of certificates is included with each certificate representing a number of years. The certificates have denominations of ten years, five years, two years, one year and ½ of a year with each player initially given certificates in the amount of seventy-five years. The certificates are accumulated based on cheerful situations and forfeited based on stressful situations encountered by a player as stated via the situation cards. A stack of "Anti-Stress" cards is included. Each card represents a way of avoiding a loss of certificates when encountering stressful situations requiring the forfeiture thereof.

Lastly, an essentially rectangular and planar game board is included and has a starting space representing the initiation of a journey through life positioned near the periphery of the game board at a corner thereof, and ending space positioned near the centroid of the game board representing a non-stressful place to live upon completion of the journey, and one hundred-twenty situation spaces representing six different categories of stressful situations, cheerful situations, and combinations thereof and three classes of actions encountered by a game piece when positioned thereon through a roll of the dice. The situation spaces extend radially inwards from the starting space to the ending space in a generally spiral configuration. The categories of stressful situations are denoted as "Migraine Headache", "Ulcer", and "Nervous Breakdown". The categories of cheerful situations are denoted as "Saturday, Sunday" and "Major Holiday". The category of both stressful and cheerful situations is denoted as "It Can Go Either Way". The classes of actions are denoted as "Anti-Stress", "Day Off", and "Go Back". Each category represented on the board is keyed to a corresponding stack of situation cards having the same category. The "Anti-Stress" class is keyed to its corresponding stack. Forty situation spaces represent "Migraine Headache" situations. Twenty-five situation spaces represent "Ulcer" situations. Ten situation spaces represent "Nervous Breakdown" situations. Fifteen situation spaces represent "It Can Go Either Way" situations. Fourteen situation spaces represent "Saturday, Sunday" situations. Three situation spaces represent "Major Holiday" situations. Three situation spaces represent "Anti-Stress" actions. Five situation spaces represent "Day Off" actions. Lastly, five situation spaces represent "Go Back" actions.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved board game relating to stress which has all the advantages of the prior art board games and none of the disadvantages.

It is another object of the present invention to provide a new and improved board game relating to stress which may be easily and efficiently manufactured and marketed.

It is a further object of the present invention to provide a new and improved board game relating to stress which is of durable and reliable construction.

An even further object of the present invention is to provide a new and improved board game relating to stress which is susceptible of a low cost of manufacture with regard to both materials and labor, and which accordingly is then susceptible of low prices of sale to the consuming public, thereby making such a board game relating to stress economically available to the buying public.

Still yet another object of the present invention is to provide a new and improved board game relating to stress which provides in the apparatuses and methods of the prior art some of the advantages thereof, while simultaneously overcoming some of the disadvantages normally associated therewith.

Even still another object of the present invention is to provide a new and improved board game relating to stress for whimsically allowing players to simulate stressful situations and cheerful situations in life.

Lastly, it is an object of the present invention to provide a new and improved board game relating to stress comprising, in combination a plurality of game pieces each representing a player; at least one dice; a plurality of stacks of situation cards with the stacks representing categories of stressful situations, cheerful situations, and combinations thereof and with each situation card describing an action required of a player; a plurality of certificates with each certificate representing a number of years of a player's life, each player initially provided at set amount of certificates, with certificates being accumulated based on cheerful situations and forfeited based on stressful situations encountered by a player; a stack of anti-stress cards with each card representing a way of avoiding a loss of certificates when encountering stressful situations requiring the forfeiture thereof; and a game board having a starting space thereon representing the initiation of a journey through life, an ending space thereon representing the completion of the journey, and a plurality of situation spaces therebetween representing stressful categories, cheerful categories, and combinations thereof of situations encountered when a game piece is positioned thereon with each category represented on the board keyed to a corresponding stack of situation cards with same category.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
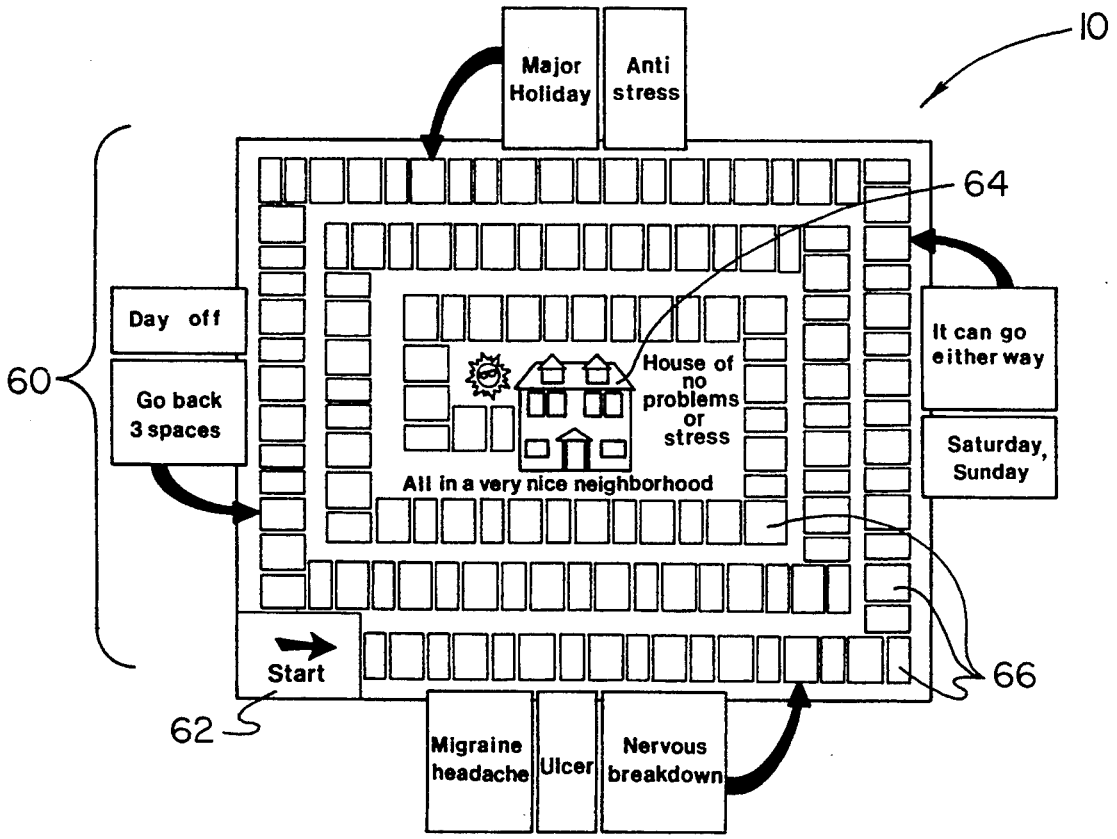
FIG. 1 is a plan view of the game board of the present invention.
Figure 2:
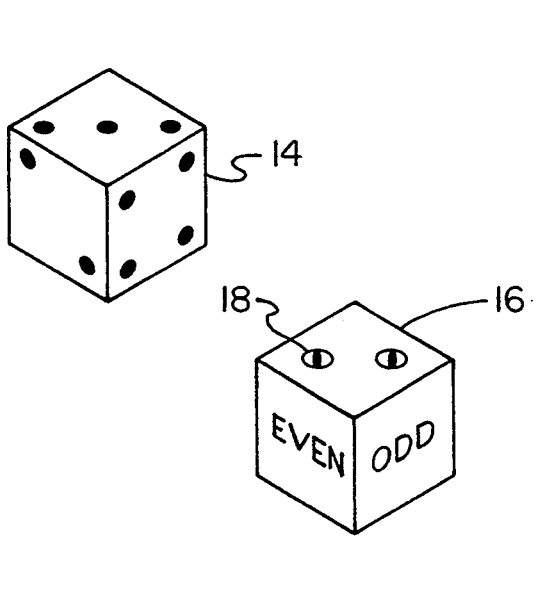
FIG. 2 is a perspective view of the two dice utilized with the board game.
Figure 3:
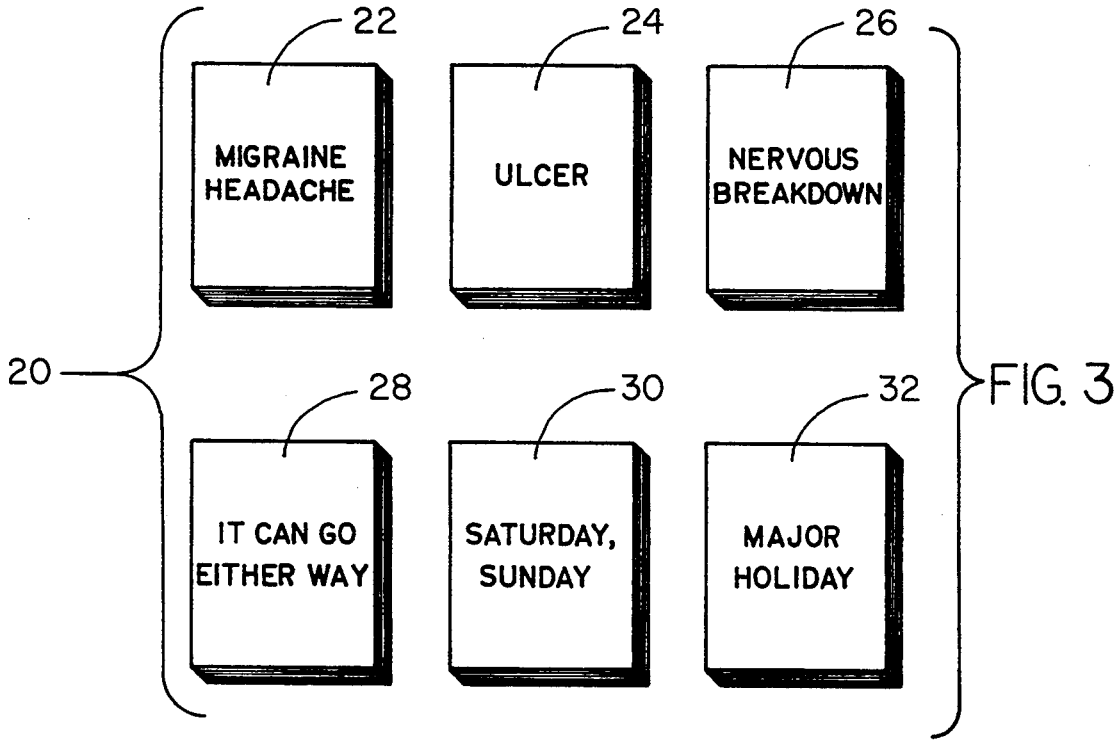
FIG. 3 is a plan view of the six stacks of situation cards and with each card describing a situation.
Figure 4:
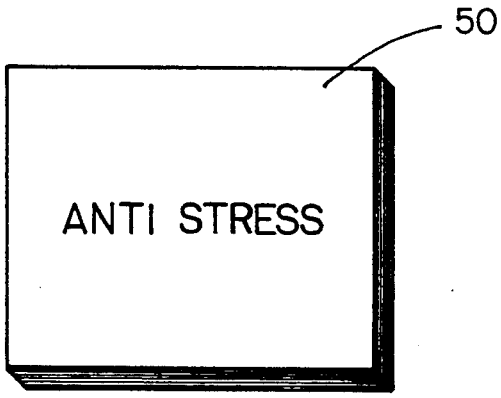
FIG. 4 is a plan view of the anti-stress cards utilized for avoiding the forfeiture of certificates representing the years of a player's life during the game.
Figure 5:
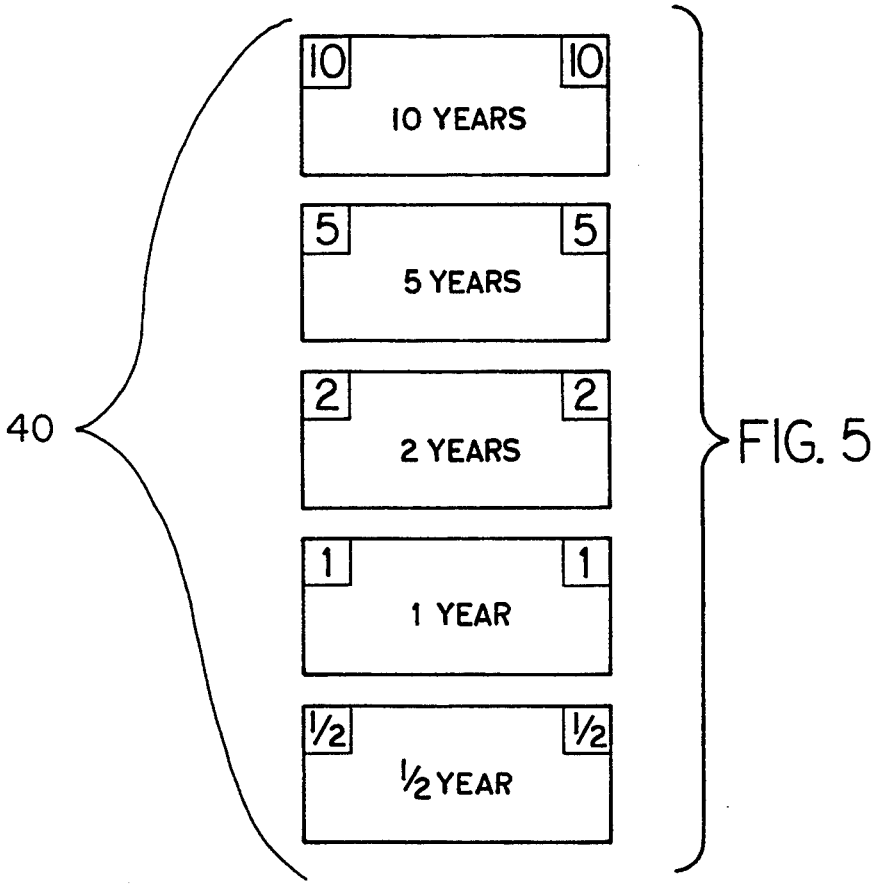
FIG. 5 is a plan view of the certificates used with the board game.
Figure 6:
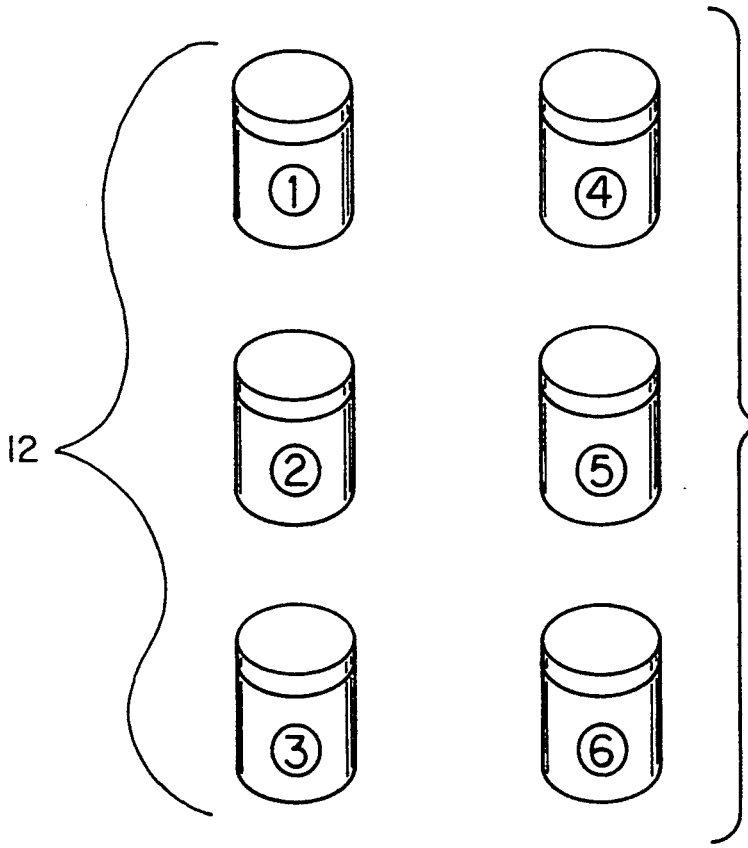
FIG. 6 is perspective view of the game pieces used with the board game.

With reference now to the drawings, and in particular, to FIG. 1 through 6 thereof, the preferred embodiment of the new and improved board game relating to stress embodying the principles and concepts of the present invention and generally designated by the reference number 10 will be described.

Specifically, the present invention includes six major components. The major components are the game pieces, dice, situation cards, certificates, "Anti-Stress" cards and game board. These components are interrelated to provide the intended function.

More specifically, it will be noted in the various Figures that the first major component is the game pieces 12. The present invention includes six game pieces. The game pieces are each shaped in the form of a numbered medicine bottle. Each medicine bottle represents a player. Each game piece is formed of a rigid material such as plastic.

The second major component is the dice. The present invention includes a first die 14 and a second dice 16. Each die has a box-shape with six faces. The first dice has its faces numbered with dotted indicia from one to six. The second die has two opposed faces having a pair of snake eyes 18 inscribed thereon, two opposed faces having the word "even" inscribed thereon, and two opposed faces having the word "odd" inscribed thereon. The position of the game pieces 12 and subsequent actions affecting them are determined by rolling the dice.

The third major component is the situation cards 20. The present invention includes six stacks of situation cards. The situation cards represent six categories of stressful situations, cheerful situations, and combinations thereof. Each card describes stressful situations and corresponding actions required of a player. Each card of the first stack 22 describes "Migraine Headache" stressful situations. Each card of the second stack 24 describes "Ulcer" stressful situations. Each card of the third stack 26 describes "Nervous Breakdown" stressful situations. Each card of the fourth stack 28 describes "It Can Go Either Way" stressful situations and cheerful situations. Each card of the fifth stack 30 describes "Saturday/Sunday" cheerful situations. Lastly, each card of the sixth stack 32 describes "Major Holiday" cheerful situations. Each card has a front face and a back face. The front face of the card includes the title of the category inscribed thereon. The back face of the card describes the situations encountered base upon the roll of the second dice.

The fourth major component is the certificates 40. The present invention includes a plurality of certificates with each certificate representing a number of years of a player's lifetime. The certificates have denominations of ten years, five years, two years, one year, and one-half of a year. Each player is initially given certificates in the amount of seventy-five years to start the game. Throughout the game, certificates are accumulated based on cheerful situations and forfeited based upon the situations encountered by player as stated via the situation cards 20.

The fifth major component is the "Anti-Stress" cards 50. The present invention includes a stack of such cards. Each card represents a way of avoiding a loss of certificates when encountering stressful situations requiring the forfeiture thereof. For example, a situation card may require a player to forfeit a given number of years by turning in a number of certificates. However, the "Anti-Stress" cards can be used in lieu of forfeiting certificates up to a certain denomination.

The sixth major component is the game board 60. The game board is essentially rectangular, planar, and rigid in structure. It is adapted to be foldable in the conventional manner to be placed in a stowed configuration. The game board has a playing surface with a starting place 62 representing the initiation of a journey through life for a player. The starting space is positioned near the periphery of the game board at a corner thereof. The journey of a player is terminated in an ending space 64. The ending space is positioned near the centroid of the game board. This space is designated by a house that represents a non-stressful place to live upon completion of the journey. The playing space also includes one hundred and twenty situations spaces 66 extended between the starting space and the ending space. The situation spaces represent six different categories of stressful situations, cheerful situations, and combinations thereof and three classes of action. Both the categories of situations and the classes of actions are encountered by a game piece when positioned on the game board through a roll of the dice. The situation spaces extend radially inward from the starting space to the ending space in a generally spiral or coiled configuration.

The categories of stressful situations are denoted as "Migraine Headache", "Ulcer", and "Nervous Breakdown". The categories of cheerful situations are denoted as "Saturday/Sunday", and "Major Holiday". The category of both stressful situations and cheerful situations is denoted as "It Can Go Either Way". The classes of actions are denoted as "Anti-Stress", "Day Off", and "Go Back". Each category is represented on the game board and keyed to a corresponding stack of situation cards 20 having the same category name. Furthermore, the "Anti-Stress" class is keyed to a stack of "Anti-Stress" cards 50.

Of the one hundred and twenty situation spaces on the game board, forty situation spaces represent "Migraine Headache" situations. Twenty-five of the situation spaces represent "Ulcer" situations. Ten of the situation spaces represent "Nervous Breakdown" situations. Fifteen situation spaces represent "It Can Go Either Way" situations. Fourteen situation spaces represent "Saturday/Sunday" situations. Three situation spaces represent "Major Holiday" situations. Three situation spaces represent "Anti-Stress" actions. Five situation spaces represent "Day Off" actions. Lastly, five situation spaces represent "Go Back" actions.

In the preferred embodiment, the game board is between about 15 inches and about 18 inches wide and between about 24 inches and about 30 inches long. There are about 500 different situation cards, with an allocation of about 5 cards per situation space. Cylindrical dice having a top and bottom surface with periphery shaped in a form of a hexagon having numbered sides therebetween can also be used in lieu of the box-shaped dice. The opposed faces representing the top and bottom of the cylindrical dice would not be utilized.

The object of the game is as the title implies, survive the stress. Game pieces include: game board, two dice; one numbered from one to six, and the second with two spaces with the word—"even", two spaces with the word—"odd", and the last space with two spaces with menacing "snake eyes", six stacks of: "Migraine Headache" situation cards, "Ulcer" situation cards, "Nervous Breakdown" situation cards, "It Can Go Either Way" situation cards, "Saturday, Sunday" situation cards, and "Major Holiday" situation cards, one stack of "Anti-Stress" action cards, one bank that "years" certificates are kept in denominations of ten years, five years, two years, one year, and one-half year (this is a designated location and/or player), and finally six game pieces that a player uses to move around the game board in the shape of medicine bottles.

You start out the game with seventy-five years to work with. You move your game piece on the board based upon the roll of the first dice. You lose years every time you land on "Ulcer" or "Nervous Breakdown" situation spaces. A roll of the second dice will determine how many years you lose upon landing on the "Ulcer" space. You lose a set number of years when you land on the "Nervous Breakdown" cards, no dice rolling here. "Migraine Headache" situation spaces can mean you lose nothing up to losing moderately a lot, all depending on the roll of the second dice. "It Can Go Either Way" means that the situation is win, lose, or break even again all depending on the roll of the second dice. "Saturday/Sunday" space is a win or break even, depending on the roll of the second dice. The "Major Holiday" space is a big winner, you win a set number of years, there is no additional dice rolling here.

One person acts as banker of the years certificates, this person can also play. The number of players is two to six people, seven people can play if one person acts solely as the banker. Each person gets seventy-five years to work with in denominations of: 20 (½ year certificates), 15 (1 year certificate), 5 (2 year certificate), 4 (5 year certificate), and 2 (10 year certificate).

The color of the years certificates are as follows: 10 year certificate=gold color, 5 year certificate=silver color, 2 year certificate=green color, 1 year certificate=blue color, and ½ year certificate=white color.

There are one hundred-twenty situation spaces on the board and are as follows as noted from A–I below:

A. 40 "Migraine Headache" situation spaces: These situation spaces are where you can break even or lose up to six years, depending on the roll of the second dice. A roll of even or odd can result in minor losses, depending on what the "Migraine Headache" card says. A roll of snake eyes means a certain larger loss of years. If you roll snakes, you must roll again to see if you roll snake eyes a second time. If you do roll snake eyes again, then you lose the number of years under the 'roll double snake eyes' heading on the "Migraine Headache" card. If you roll snake eyes only once then you only lose the number of years under the 'roll snake eyes' heading on the "Migraine Headache" card.

B. 25 "Ulcer" situation spaces: These situation spaces are more stressful than the "Migraine Headache" situation spaces and thus will lose more years. You lose 3 years minimum on these situation spaces, and a maximum of 8 years. The roll of the second dice will decide upon how many years you will lose. Odd or even you will lose a moderate amount of years. Roll snake eyes you will lose much more. If you roll snake eyes you do not roll again like the above "Migraine Headache" cards, only roll once and lose the number of years that the card tells you to.

C. 10 "Nervous Breakdown" situation spaces: Upon landing on this space simply pick up the card in "Nervous Breakdown" stack and lose big. There is no rolling of dice here. Lose minimum of 8 years, with a maximum of 15 years.

D. 15 "It Can Go Either Way" situation spaces: Here you can actually win, break even, or lose. Fortunately the only way to lose here is to roll snake eyes. After you land here, roll the second dice to see if you win, or break even. The maximum win or lose is 2 years.

E. 14 "Saturday, Sunday" situation spaces: This is a "can't lose" space. Rolling an even or odd on the second dice will guarantee a win of some years, though a roll of snake eyes will give you nothing, snake eyes=break even.

F. 3 "Major Holiday" situation spaces: Here you win big, this is a feel good space to land on. Rare to land on though. No dice rolling of the second dice. Just read the card and collect the years from the bank. Minimum win 7 years, maximum win is 11 years.

G. 2 "Anti-Stress" card situation spaces: This is a valuable space to land on since you are given an "Anti-Stress" card. this card can be used at any time to avoid losing years upon landing on the "Migraine Headache", or "Ulcer" situation spaces. It must be used before you roll the second dice. In other words you can't decide to use this card after you have made a bad roll of the second dice, it must be used before. If you decide to use the card simply treat the "Migraine Headache" or "Ulcer" space as a free space. Note: You can sell your "Anti-Stress" card to another player so long as they use it before they roll the second dice. Also note: The card is only good for the "Migraine Headache" and "Ulcer" situation spaces, and must be used before the player reaches the end of the game, or the card becomes worthless.

H. 5 "Day Off" situation spaces, this is another way of simply saying that this is a free space, where nothing bad or good can happen here.

I. 5 "Go Back" situation spaces (# spaces, where # is a numeral), just as it sounds—go back the # of spaces.

A player is eliminated when they lose all of their years.

The winner of the game is the player that reaches the center house of no problems and no stress, all in a very nice neighborhood, and has the most years left over. The person with the most years left over that has reached the house is the first place winner of the game, but those other players that reached the house with fewer years still get to be distinguished as second place, third place winners and so on, since the object of the game is to survive the stress. In the event that only one player is left and has not reached the center house, then the player gets free passage to the house and is declared the winner of the game.

Approximate playing time will vary from 45–75 minutes with two players, up to about 2–3 hours with six players.

It is often one says after a frightening or stressful situation, "Oh, that must have taken five years off of my life." This game takes and gives you years on your fictional life, mostly takes years off of it, and this is the way it should be look upon as, "purely fictional". This game is meant for one to laugh at some of the situations that almost all of us face everyday, but is not meant to make fun of other people's misfortunes. To be able to laugh at a stressful or embarrassing situation makes it easy to be able to cope with it. With this game you fictionally live the stressful situations, and are hopefully able to laugh at these and the outcomes of the roll of the dice. Since so often a stressful situation comes about through, and is guided by dumb chance, it is appropriate that through the roll of the dice decides how well you do in the game.

Since actual life is not always filled with stress and hardships, it is only right to include safe and happy situation spaces on the game. Even with what seems to be a wonderful situation, through bad luck it can turn into something not so good. This is why with every space requiring a roll of the second dice except the "Nervous Breakdown" and "Major Holiday" situation spaces, snake eyes can make a bad problem worse or a good situation turn sour. It would not be appropriate to make a terrible problem worse, or a joyous event turn into something lousy, this is why these two situation spaces do not require rolling of the second dice.

The house of no problems and no stress, all in a very nice neighborhood. Since almost all of us aim for a peaceful place to live, without the everyday stress and crime, it seems only reasonable for the end of a stress game to end in such a place. Everyone that reaches here is a winner. The one with the most years left is the first place winner.

Shown below are some examples of "Migraine Headache" situation cards. Situation cards for other categories describe similar whimsical incidents and provide instructions that a player must follow based upon the roll of the dice.

| Example Card 1: | |
|---|---|
| You over cook the holiday turkey again: | |
| Roll even: | Roll snake eyes: |
| It's not too dried out, and deeper down its tender. Lose 0 years. | Get 2 hours of relative's lecture on how not to burn food. Lose 2½ years. |
| Roll odd: | Roll double snake eyes: |
| Have plenty of water and other food items, because the turkey is DRY! Lose 1 year. | Not one, but three people choke at the same time on your burnt bird. Lose 5 years. |

| | |
|---|---|
| You have bad breath: | |
| Roll even: | Roll snake eyes: |
| No problem, you keep an arsenal of mouth spray. Lose 0 years. | Have new boyfriend or girlfriend tell you that you have dragon breath. Lose 2 years for embarrassment. |
| Roll odd: | Roll double snake eyes: |
| Everybody in the room is smoking, so no one else knows. Still lose 1 year for feeling self conscious about it. | Have person across the room start choking on it. Lose 4 years. |

| Example Card 3: | |
|---|---|
| Get stuck watching friend's or relatives' home movies: | |
| Roll even: | Roll snake eyes: |
| They're not too bad, some nice scenery, still a little boring. Lose ½ year for not having something better to do. | You get to watch 5 hours of the couple's newborn burp, spit-up and listen to everyone say, "Oh isn't that cute". Lose big fat 4½ years. |
| Roll odd: | Roll double snake eyes: |
| Movies all of people making fools out of themselves. 10 minutes amusement, 3 hrs shear boredom. Lose 1½ yrs. | Start having reoccurring nightmares about couple's "so proud" home movies. Lose 6 years. |

| Example Card 4: | |
|---|---|
| Your kid wants a pet: | |
| Roll odd: | Roll snake eyes: |
| You get a dog or a cat. Lose 0 years. | Your new pet is a 10 foot long python. Lose 3 years. |
| Roll even: | Roll double snake eyes: |
| You get a loud bird that doesn't like you, but does like ears. ½ yrs. | That new python of course gets loose in the neighborhood. Lose 5 years. |

As an option, players may choose to use or not use, is the use of blank cards to add their own personal favorite ways or past experiences to gain back or forfeit (lose) years on their fictional board game lives.

Figures 7, 8:
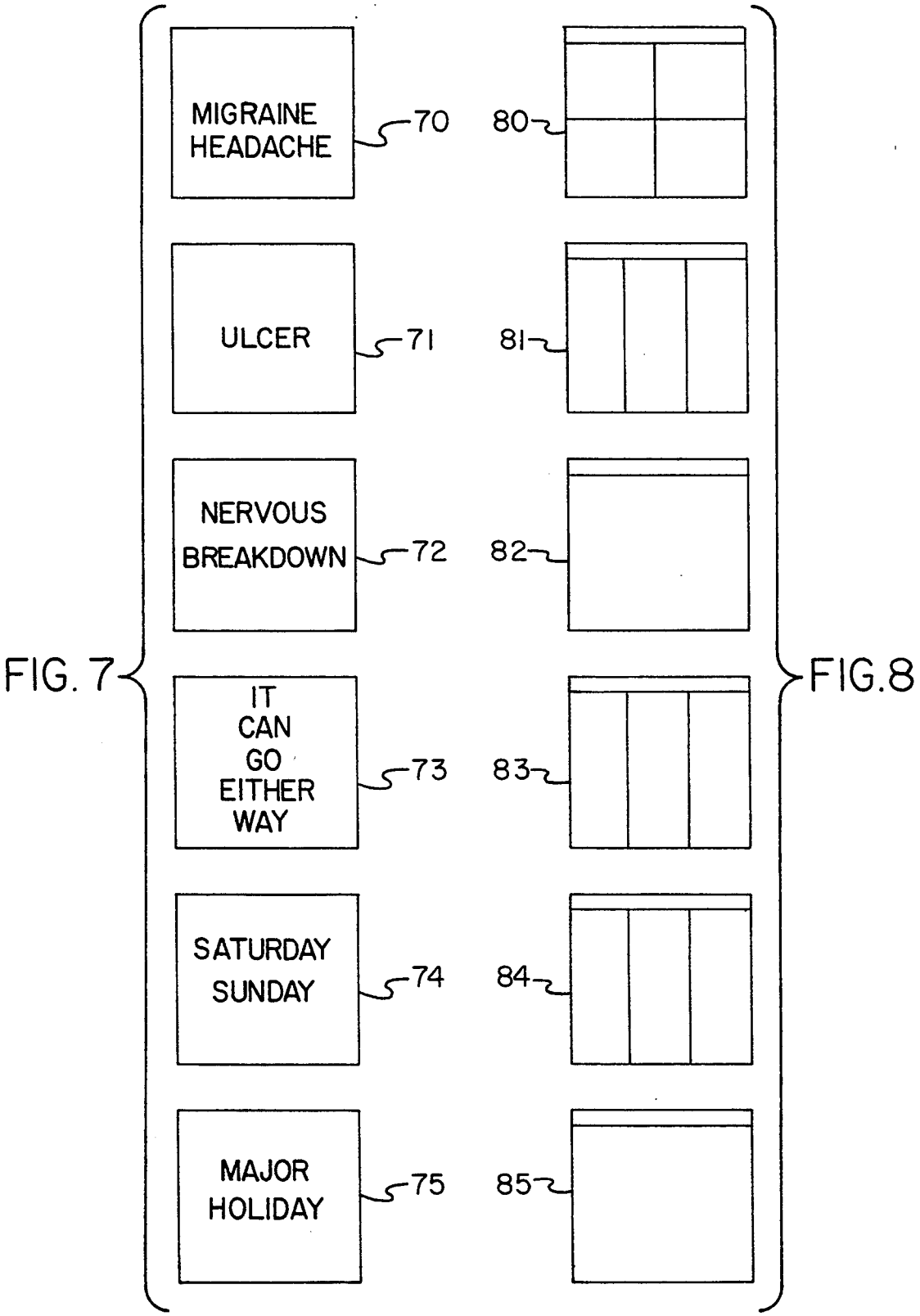
FIGS. 7 and 8 are views of the back and front sides, respectively, of "blank" cards.

These cards would be inscribed with an appropriate situation on one side, with the other side blank. The situation side would be the same as one of the six regular situations: "Migraine Headache", "Ulcer", "Nervous Breakdown", "It Can Go Either Way", "Saturday, Sunday", and "Major Holiday". There would be 5 to 15 of these additional special cards for each of the six different categories of situations, for a total of 30 to 90 additional special cards. Note the alternate embodiment of FIGS. 7 and 8. FIG. 7 shows the back side of such cards as cards 70, 71, 72, 73, 74 and 75. The front side 80, 81, 82, 83, 84 and 85 are initially blank for a player to write additional situations of an appropriate nature. Such writings must be done prior to initiating any game.

These additional special cards would function as regular cards when the blank sides were filled in with the appropriate information. These cards would be shuffled into the appropriate deck. Example: an Ulcer card that was blank and filled in properly would be put into the regularly printed "Ulcer" card deck, as so would the other five decks. These special cards would look identical to the other cards in the appropriate deck face down.

A player would of course make up the blank cars before the game started, and would have to keep the special cards within the parameters of the game. Example: A player could not take away more than 6 years on a blank "Migraine Headache" card or lose more than 2 years on an "It Can Go Either Way" blank card, and so on. The best advice for a player that wishes to add this fun option to the game is to use the regular cards with stressful or cheerful situations already printed on them as a guide, and follow the rules of the game.

The advantages of having an optional addition to this board game is that it is an option. If a person wishes to add one of their experiences or 20, they are able to enjoy a more personalized game without changing the parameters of the game at all. If a person does not wish to add any experiences or clever situations to the blank cards, then the game will still be fun to play with the already made up cards.

If a person decides to use the blank cards in addition to the regular cards, then it is almost quite possible that the cards can become almost like a diary of a humorous events that one can laugh about "now", and incorporate into the game, again without changing the parameters of the game. An advantage to this optional personalized approach is that people can make this into a real family or friendship game in which people can write down their funny experiences, and put these into regular stacks of situations and enjoy them as one plays along.

A final advantage to this optional addition is when a person or family has written down their own experiences and added it to an already humorous game, the cards and game become sort of a personal possession. A person will be more likely to keep this type of game since certain cards might have their own personal experiences on it. It should also be noted that many of today's board games become "old" quite quickly and end up stored in the closet. A game with this humorous addition of blank cars will not readily grow old since new humorous situations happen to all of us almost on a daily occurrence. Since a lot of people like to talk about the past events that they can now laugh about, these personalized cards can be handed down generation to generation as a way of remembering people. It should be noted that additional blank cards and regular cards should be made available to interested customers to keep the game from becoming "old".

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A board game relating to stress for whimsically allowing players to simulate stressful situations and cheerful situations in life comprising, in combination:

six game pieces each formed in a shape of a numbered medicine bottle and each representing a player;

a first die and a second die each having a box-shape with six faces, the first die further having its faces numbered with dotted indicia from one to six, the second die further having two opposing faces with a pair of snake eyes inscribed thereon, two opposing faces with the word even inscribed thereon, and two opposing faces with the word odd inscribed thereon;

six stacks of situation cards representing six categories of stressful situations, cheerful situations, and combinations thereof, each card describing situations and corresponding actions required of a player, each card of the first stack describing Migraine Headache stressful situations, each card of the second stack describing Ulcer stressful situations, each card of the third stack describing Nervous Breakdown stressful situations, each card of the fourth stack describing It Can Go Either Way stressful situations and cheerful situations, each card of the fifth stack describing Saturday, Sunday cheerful situations, and each card of the sixth stack describing Major Holiday cheerful situations;

a plurality of certificates with each certificate representing a number of years, the certificates having denominations of ten years, five years, two years, one year and ½ of a year with each player initially given certificates in the amount of seventy-five years, with the certificates being accumulated based on cheerful situations and forfeited based on stressful situations encountered by a player as stated via the situation cards;

a stack of Anti-Stress cards with each card representing a way of avoiding a loss of certificates when encountering stressful situations requiring the forfeiture thereof; and an essentially rectangular and planar game board having a starting space representing the initiation of a journey through life positioned near the periphery of the game board at a corner thereof, an ending space positioned near the center of the game board representing a non-stressful place to live upon completion of the journey, and one hundred-twenty situation spaces representing six different categories of stressful situations, cheerful situations, and combinations thereof and three classes of actions encountered by a game piece when positioned thereon through a roll of the dice, the situation spaces extended from the starting space to the ending space in a generally spiral configuration, the categories of stressful situations denoted as Migraine Headache, Ulcer, and Nervous Breakdown, the categories of cheerful situations denoted as Saturday, Sunday and Major Holiday, and the categories of stressful situations and cheerful situations denoted as It Can Go Either Way, the classes of actions denoted as Anti-Stress, Day Off, and Go Back and with each category represented on the board keyed to a corresponding stack of situation cards having the same category and the Anti-Stress class keyed to the stack of Anti-Stress cards, with 40 situation spaces representing Migraine Headache situations, 25 situation spaces representing Ulcer situations, 10 situation spaces representing Nervous Breakdown situations, 14 spaces representing Saturday, Sunday situations, 3 situation spaces representing Major Holiday situations, 15 situation spaces representing It Can Go Either Way situations, 3 situation spaces representing Anti-Stress actions, 5 situation spaces representing Day Off actions, and 5 situation spaces representing Go Back actions.

2. A board game relating to stress for whimsically allowing players to simulate stressful situations and cheerful situations in life comprising, in combination:

a plurality of game pieces each representing a player; at least one die;

a plurality of stacks of situation cards with the stacks representing categories of stressful situations, cheerful situations, and combinations thereof and with each situation card describing an action required of a player;

a plurality of certificates with each certificate representing a number of years of a player's life, each player initially provided a set amount of certificates, with certificates being accumulated based on cheerful situations and forfeited based on stressful situations encountered by a player;

a stack of anti-stress cards with each card representing a way of avoiding a loss of certificates when encountering stressful situations requiring the forfeiture thereof; and a game board having a starting space thereon representing the initiation of a journey through life, an ending space thereon representing the completion of the journey, and a plurality of situation spaces therebetween representing stressful categories, cheerful categories, and combinations thereof of situations encountered when a game piece is positioned thereon with each category represented on the board keyed to a corresponding stack of situation cards with the same category.

3. The board game as set forth in claim 2 wherein a first die and a second die are included with each having a box-shape with six faces, the first die having its faces numbered with dotted indicia from one to six, the second die having two opposing faces each having a pair of snake eyes inscribed thereon, two opposing faces each having the word even inscribed thereon, and two opposing faces having the word odd inscribed thereon.

4. The board game as set forth in claim 2 wherein the stacks comprise a first stack, second stack, third stack, fourth stack, fifth stack, and sixth stack of situation cards with each card of the first stack describing a Migraine Headache stressful situation, each card of the second stack describing an Ulcer stressful situation, each card of the third stack describing a Nervous Breakdown stressful situation, each card of the fourth stack describing an It Can Go Either Way stressful situation or cheerful situation, each card of the fifth stack describing a Saturday, Sunday cheerful situation, and each card of the sixth stack describing a Major Holiday cheerful situation and with the situations spaces representing Migraine Headache situations, Ulcer situations, Nervous Breakdown situations, It Can Go Either Way situations, Saturday, Sunday situations, and Major Holiday situations.

5. The board game as set forth in claim 2 wherein the situation spaces are extended from the starting space to the ending space in a coiled configuration.

6. The board game as set forth in claim 2 further including a plurality of blank situation cards adapted to be inscribed with personalized stressful situations, cheerful situations, and combinations thereof as well as actions required of a player.

* * * * *